US005107553A

United States Patent [19]

Mizrahi

[11] Patent Number: 5,107,553

[45] Date of Patent: Apr. 28, 1992

[54] COMBINATION SOFABED-DOUBLE BED WITH PIVOTABLE BACKREST

[76] Inventor: Moshe Mizrahi, 27 Bakher Street, Tel Aviv 67328, Israel

[21] Appl. No.: 747,645

[22] Filed: Aug. 20, 1991

[51] Int. Cl.[5] ..... A47C 17/32

[52] U.S. Cl. ..... 5/29; 5/53.2; 5/411

[58] Field of Search ..... 5/29, 28, 53.2, 30, 5/35, 53.3, 411

[56] References Cited

U.S. PATENT DOCUMENTS

| | | | |
|---|---|---|---|
| 138,840 | 5/1873 | Bayles et al. | 5/29 |
| 198,301 | 12/1877 | Jensen | 5/29 |
| 200,845 | 3/1878 | Richter | 5/29 |
| 3,151,342 | 10/1964 | McLean | 5/29 |

FOREIGN PATENT DOCUMENTS

| | | | |
|---|---|---|---|
| 28709 | 11/1964 | United Kingdom | 5/28 |

*Primary Examiner*—Alexander Grosz
*Attorney, Agent, or Firm*—Goodman & Teitelbaum

[57] ABSTRACT

A combination piece of furniture providing a couch which can be converted into a bed, including a first frame enclosing a first platform, a second frame enclosing a second platform and a hinge for pivotally connecting the first platform to the second platform so that the second frame can be pivoted 180° between a first mode, when the second platform is disposed on the first platform to form the couch, and a second mode, when the second platform is disposed adjacent to the first platform in a side-by-side arrangement to form the bed. A hinge pivotally connects a back rest to a rear portion of the second platform so that the back rest can be pivoted between an upright position extending perpendicular to the second platform, when the second frame is in the first mode, and a folded position resting on the second platform, when the second frame is in the second mode. A plate hinged to the second frame is wedged against a step-like member disposed on the back rest to maintain the back rest in the folded position on the second platform. Preferably, the first frame is provided with four supporting legs, and the second frame is provided with two supporting legs.

12 Claims, 3 Drawing Sheets

COMBINATION SOFABED-DOUBLE BED WITH PIVOTABLE BACKREST

BACKGROUND OF THE INVENTION

This invention relates to furniture and, more particularly, to a piece of so-called "combination furniture", and particularly to a couch which can be converted easily into a spacious double bed.

In small flats or single room apartments, need has been felt for an "extra bed" which might serve an occasional guest or even when the permanent occupier of a small apartment requires a double bed. The piece of furniture to be described fulfills the said desideratum, while when not in use as sleeping accommodation, it is used as part of the living room furniture. The conversion from one mode to the other is performed easily due to the unique construction.

SUMMARY OF THE INVENTION

It is accordingly an object of the present invention to provide a combination furniture which avoids the problems of prior art devices.

Another object of the present invention is to provide a combination furniture which can easily be converted between a couch and a spacious double bed.

A further object of the present invention is to provide a combination furniture which is inexpensive to manufacture, has few moving parts, and can be readily assembled.

Briefly, according to the invention, the new piece of furniture comprises two almost identical parts which are interconnected longitudinally with a hinge, the first part is provided with four legs while the second part being slightly smaller is provided with two supporting legs. A back rest is pivotally connected to the second part, which is supported by said two supporting legs when in one mode of use, such as a couch, and means for securing said back rest in a folded position when in the second mode of use, such as a double bed.

BRIEF DESCRIPTION OF THE DRAWINGS

With the above and additional objects and advantages in view, as will hereinafter appear, this invention comprises the devices, combinations and arrangements of parts hereinafter described by way of example and illustrated in the accompanying drawings of a preferred embodiment in which.

In the various figures of the drawings, like reference characters designate like parts.

DESCRIPTION OF THE PREFERRED EMBODIMENT

Figure 1:
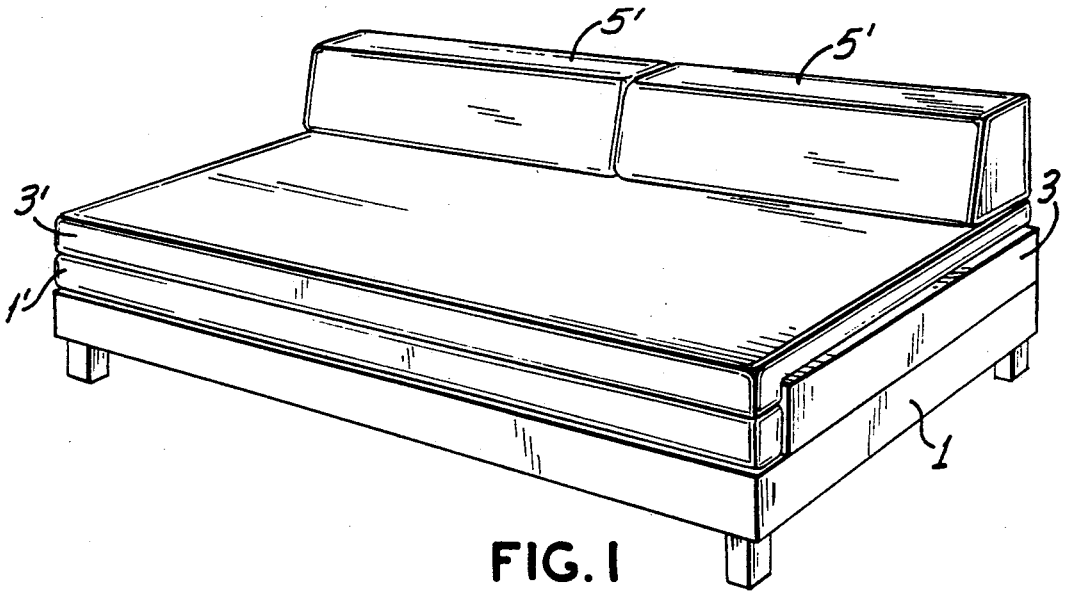
FIG. 1 is a perspective illustration of a couch according to the present invention.
Figure 2:
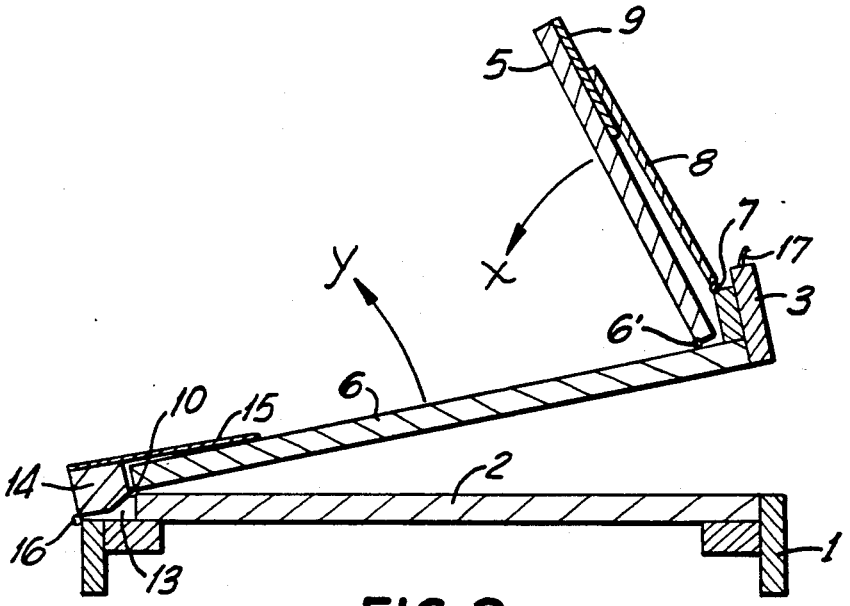
FIG. 2 is a cross section of the couch.

Referring now to the drawings, FIG. 1 shows a convertible couch in a "couch" mode according to the present invention, which includes a front, rear and sides connected together to form a rectangular rigid frame 1, preferably of wood, enclosing a rigid rectangular platform 2 (FIG. 5) which serves to support a removable mattress, either in one or in several parts. A second similar rigid frame 3, which includes a rear and side walls to enclose a rectangular platform 6 (FIGS. 3*a* and 5), is placed on top of frame 1 so that the platform 6 lies on top of the platform 2. Mattresses 1' and 3' are placed on top of each other and rest on the platform 6, as shown in FIG. 1. A back rest 5, as shown in FIG. 2, is connected to the platform 6 by a hinge 6', as will be further discussed below. A pair of removable back cushions 5' are disposed on top of the mattress 3' and rest against the back rest 5, as shown in FIG. 1.

Figure 3A:
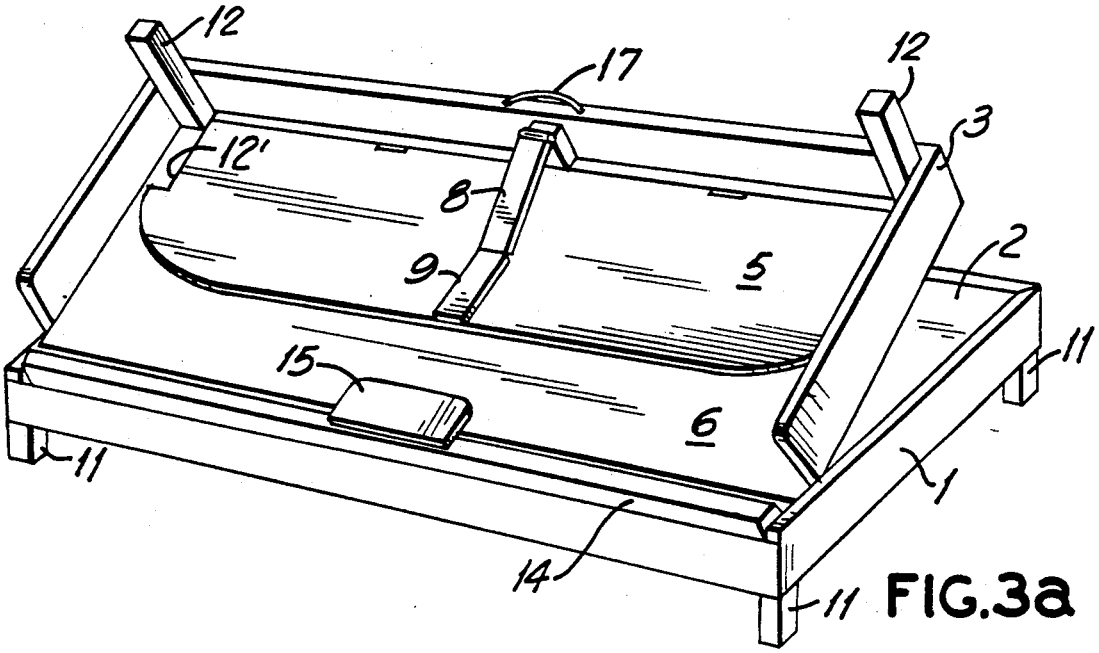
FIG. 3*a* illustrates the manner in which the couch is converted into a double bed.
Figure 4:
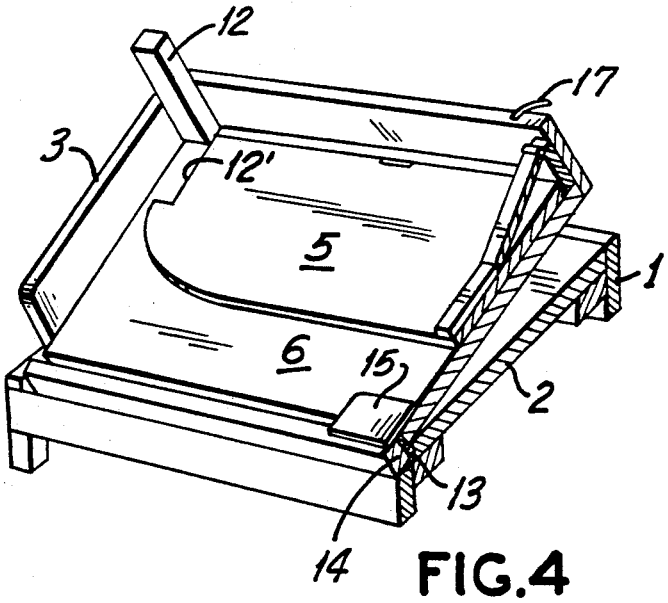
FIG. 4 is a cross section of FIG. 3*a;*.

As shown in FIGS. 2, 3*a* and 4, a conventional spring biased hinge 7 pivotally connects one end of a plate 8 to the frame 3 so that the opposite end of the plate 8 applies pressure on the back rest 5. A step-like member 9 is secured on the back rest 5 for co-acting with the plate 8 as will be explained below.

Figure 5:
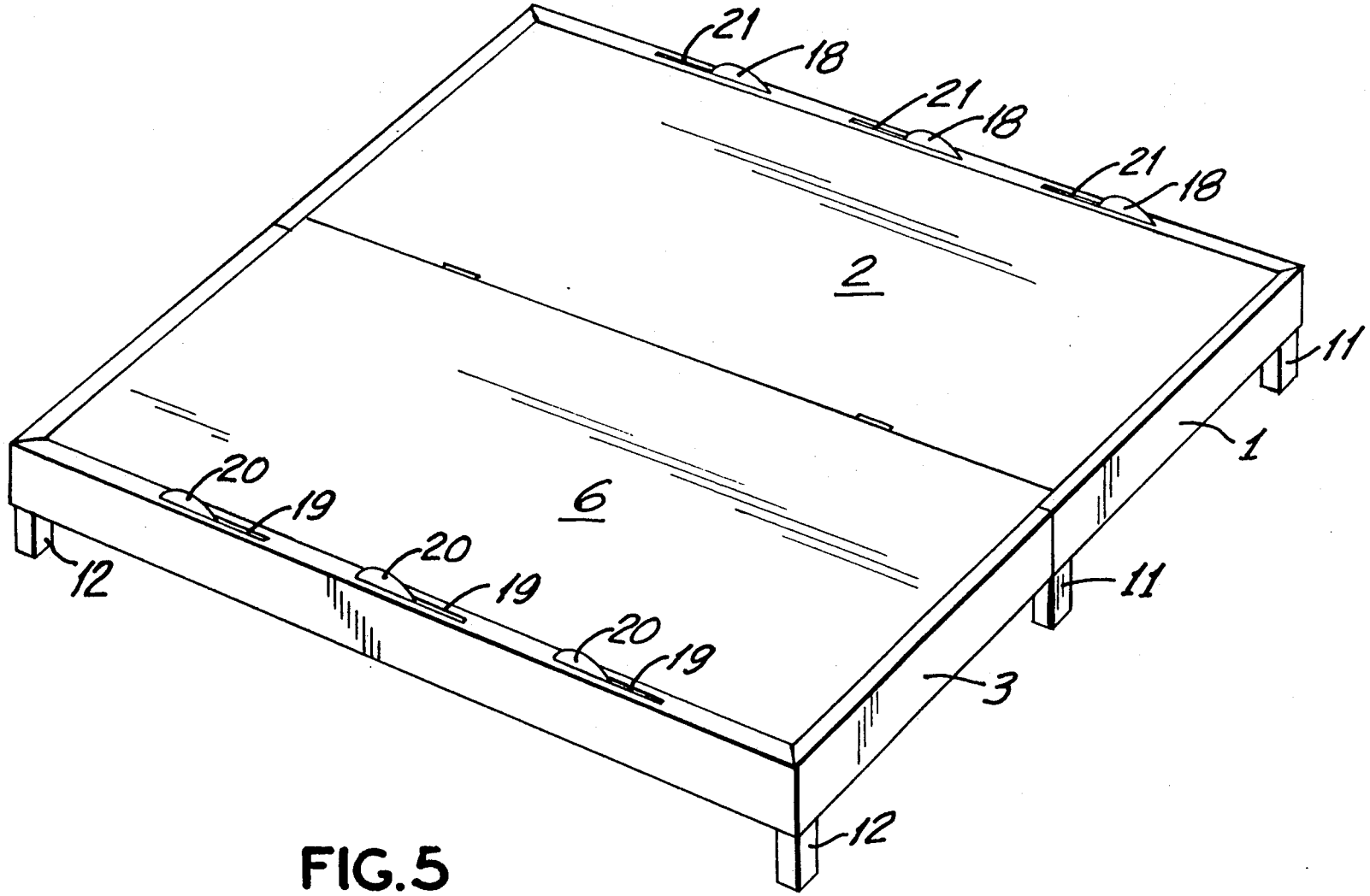
FIG. 5 illustrates the "open" position of the couch.

As best shown in FIG. 2, a longitudinal hinge 10 pivotly connects the platform 6 to the platform 2 so that the frame 3 can be pivoted a 180° to rest in a "bed" mode on one side of the frame 1 on the two supporting legs 12 of the frame 3, which are similar to the four supporting legs 11 of the frame 1, as best shown in FIG. 5. It is noted, that the support legs 11 and 12, as well as the height of the frames 1 and 3, can be made longer or shorter depending upon the particular design of the convertible couch. It is further noted, that if desired, the supporting legs 11 and 12 can be eliminated so that in the "couch" mode the frame 1 of the convertible couch would rest on the floor, and in the "bed" mode the frames 1 and 3 of the double bed would rest on the floor.

Figure 3B:
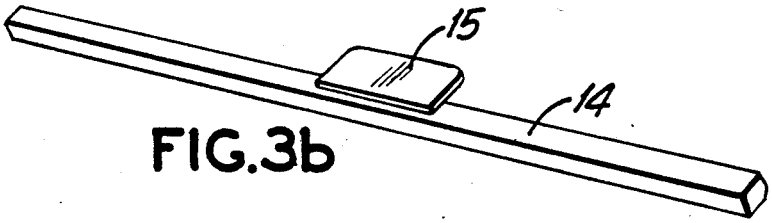
FIG. 3*b* is a perspective view of the beam shown in FIG. 3*a;*

As shown in FIGS. 3*a* and 4, cut-outs 12' are provided on opposite sides of the back rest 5 to receive the supporting legs 12 therein when the back rest 5 is in the upright position in the "couch" mode. FIGS. 2 and 4 show a longitudinal cut-out 13 provided in the frame 1 adjacent to the ends of the platforms 2, 6 which are connected together by the hinge 10. The cut-out 13 receives a beam 14 therein when the piece of furniture is in the "couch" mode. The beam 14 is pivotally connected along the longitudinal edge of the frame 1 by a hinge 16. As best shown in FIG. 3*b*, the beam 14 is provided with a centrally located tab member 15 secured thereto, which rests on the platform 6 as shown in FIGS. 2, 3*a* and 4, the function of which will be described below. Preferably, a rope-like handle 17 is secured to a central edge portion of the rear of the frame 3 adjacent to the plate 8, as shown in FIG. 3*a*.

As shown in FIG. 5, the edge of the frame 1 is provided with spaced apart semicircular disc-like projections 18 which are received in associated spaced apart mating recesses 19 in the edge of the frame 3 when in the "couch" mode. Likewise, the edge of the frame 3 is also provided with spaced apart semicircular disc-like projections 20 which are received in associated spaced apart mating recesses 21 in the edge of the frame 1 when in the "couch" mode. The projections 18, 20 maintain the mattresses 1', 3' on the frames 1, 3 when the furniture is in the "bed" mode.

Accordingly, when it is desired to convert the couch, as shown in FIG. 1, into a double bed, as shown in FIG. 5, the mattresses 1', 3' and the back cushions 5' are removed from the frame 3. The back rest 5 is now pivoted outwardly, by pulling on the rope-like handle 17, in the direction of arrow X about the hinge 6', as shown in FIG. 2, in order to rest the back rest 5 on the platform 6, as shown in FIG. 3*a*. During the pivoting of the back rest 5, the spring biased plate 8 maintains its pressure on the back rest 5 so that the plate 8 pivots with the back rest 5. When the back rest 5 is in its folded position on the platform 6, the free end of the plate 8 engages the step-like member 9, as shown in FIGS. 3*a*, 4, so that the plate 8 acts as a wedge to prevent the lifting of the back rest 5 from the platform 6.

The frame 3 is now lifted off the frame 1 and is rotated 180° about the hinge 10 in the direction of the arrow Y so that the two supporting legs 12 of the frame 3 come to rest on the floor, as shown in FIG. 5. During the pivoting of the frame 3, the platform 6 applies pressure on the tab member 15 of the beam 14 so that the tab member 15 rotates with the platform 6 and, in turn, rotates the beam 14 about its hinge 16 thus pivoting the beam 14 out of the cut-out 13. The cut-out 13 is now empty to receive the hinged end portion of the platform 6 therein. The piece of furniture is now in the "bed" mode as shown in FIG. 5, so that the mattresses 1', 3' can be placed on the platforms 2, 6 of the frames 1, 3, respectively, between the projections 18, 20. If desired, the back cushions 5' can be placed on the mattresses 1', 3' at the head of the double bed to function as a headrest.

It is noted, that when the frame 3 is pivoted back on top of frame 1, the tab member 15 can then be pivoted back to rest on the platform 6, either by hand or by a spring connected between the tab member 15 and the platform 6, so that the beam 14 is pivoted into the cut-out 13, as shown in FIG. 4. The free end of the plate 8 is now lifted, by hand, to disengage the plate 8 from the step-like member 9, so that the back rest 5 can be pivoted back to the upright position for the "couch" mode.

Numerous alterations of the above structures herein discussed will suggest themselves to those skilled in the art. However, it is to be understood that the present disclosure relates to a preferred embodiment of the invention which is for purposes of illustrations only, and is not to be construed as a limitation of the invention.

What is claimed is:

1. A combination piece of furniture comprising:

a first frame including a front, rear and sides connected together to enclose a first platform;

a second frame including a rear and sides connected together to enclose a second platform;

first hinge means for pivotally connecting a front portion of said first platform to a front portion of said second platform so that said second frame can be pivoted 180° between a first mode, when said second platform is disposed on said first platform to form a couch, and a second mode, when said second platform is disposed adjacent to said first platform in a side-by-side arrangement to form a bed;

a back rest; and second hinge means for pivotally connecting said back rest to a rear portion of said second platform so that said back rest can be pivoted between an upright position extending perpendicular to said second platform, when said second frame is in said first mode, and a folded position resting on said second platform, when said second frame is in said second mode.

2. A combination piece of furniture according to claim 1, including wedge means for maintaining said back rest in said folded position on said second platform.

3. A combination piece of furniture according to claim 2, wherein said wedge means include a plate, a spring biased hinge pivotally connecting one end of said plate to said rear of said second frame so that an opposite end of said plate applies pressure on said back rest, and a step-like member disposed on a free end portion of said back rest for engaging said opposite end of said plate when said back rest is in said folded position on said second platform.

4. A combination piece of furniture according to claim 1, wherein said first frame includes a longitudinal cut-out adjacent said front of said first frame to receive said front portion of said second platform therein when said second frame is in said second mode.

5. A combination piece of furniture according to claim 4, wherein a beam is disposed in said cut-out when said second frame is in said first mode, third hinge means for pivotally connecting said beam to said front of said first frame 6. A combination piece of furniture according to claim 5, wherein said beam is provided with a centrally located tab member, said tab member rests on said second platform when said second frame is in said first mode so that said tab member rotates with said second platform when said second frame is pivoted from said first mode to said second mode in order to pivot said beam out of said cut-out.

7. A combination piece of furniture according to claim 1, wherein said first frame is provided with four supporting legs, and said second frame is provided with two supporting legs adjacent said rear of said second frame.

8. A combination piece of furniture according to claim 1, wherein an edge of said rear of said first frame is provided with first projections and an edge of said rear of said second frame is provided with second projections for maintaining mattresses on said first and second platforms when said second frame is in said second mode.

9. A combination piece of furniture according to claim 8, wherein said edge of said rear of said first frame is provided with first recesses for matingly receiving said second projections and said edge of said rear of said second frame is provided with second recesses for matingly receiving said first projections when said second frame is in said first mode.

10. A combination piece of furniture according to claim 1, including first and second mattresses, said first and second mattresses being placed on top of each other and rest on said second platform when said second frame is in said first mode to form said couch, and said first mattress being disposed on said first platform and said second mattress being disposed on said second platform when said second frame is in said second mode to form said bed.

11. A combination piece of furniture comprising two rectangular frames and supports providing almost identical first and second parts which are interconnected longitudinally with a hinge, said first part is provided with four legs and said second part being slightly smaller is provided with two supporting legs, a back rest is pivotally connected to said second part, said back rest is supported by said two supporting legs of said second part when in one mode of use, and means for securing said back rest in a folded position when in a second mode of use.

12. A combination piece of furniture according to claim 11, wherein said back rest is secured in said folded position by means of a spring biased plate.

* * * * *